United States Patent [19]

Wilkinson

[11] Patent Number: 5,070,560

[45] Date of Patent: Dec. 10, 1991

[54] PRESSURE RELIEF SUPPORT SYSTEM FOR A MATTRESS

[75] Inventor: John W. Wilkinson, Bennington, Vt.

[73] Assignee: Healthflex, Inc., Bennington, Vt.

[21] Appl. No.: 601,314

[22] Filed: Oct. 22, 1990

[51] Int. Cl.[5] ..... A47C 27/00; A47C 23/30

[52] U.S. Cl. ..... 5/455; 5/448; 5/481; 5/465; 5/241; 5/236.1

[58] Field of Search ..... 5/236.1, 237, 238, 241, 5/448, 449, 455, 464, 465, 481

[56] References Cited

U.S. PATENT DOCUMENTS

| | | | |
|---|---|---|---|
| 646,542 | 4/1900 | Lively | 5/238 |
| 3,146,469 | 9/1964 | Slade | 5/465 |
| 3,293,671 | 12/1966 | Griffin | 5/481 |
| 3,742,528 | 7/1973 | Münch | 5/481 |
| 3,828,378 | 8/1974 | Flam | 5/464 |
| 4,525,886 | 7/1985 | Savenije | 5/236.1 |
| 4,628,557 | 12/1986 | Murphy | 5/464 |
| 4,682,378 | 7/1987 | Savenije | 5/241 |
| 4,706,313 | 11/1987 | Murphy | 5/481 |
| 4,803,744 | 2/1989 | Peck | 5/455 |
| 4,827,544 | 5/1989 | Hüsler | 5/241 |

FOREIGN PATENT DOCUMENTS

| | | | |
|---|---|---|---|
| 38155 | 10/1981 | European Pat. Off. | 5/238 |
| 3505644 | 8/1986 | Fed. Rep. of Germany | 5/238 |
| 8102384 | 9/1981 | PCT Int'l Appl. | 5/481 |

*Primary Examiner*—Gary L. Smith
*Assistant Examiner*—F. Saether
*Attorney, Agent, or Firm*—Heslin & Rothenberg

[57] ABSTRACT

The pressure relief support system contains longitudinal air cylinders having wood slats extending across the air cylinders along the length of the air cylinders forming the shape of a mattress. Foam strips may be included on each of these slats to provide an improved pressure relief mattress system for optimal patient comfort.

12 Claims, 3 Drawing Sheets

FIG. 1
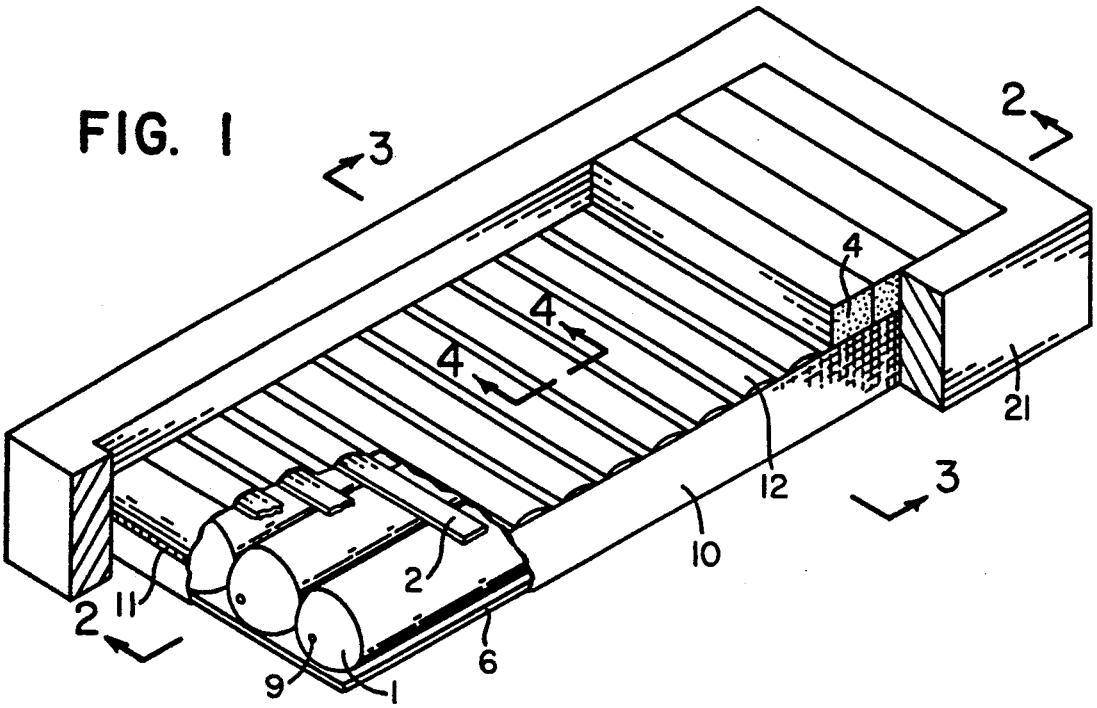
FIG. 2
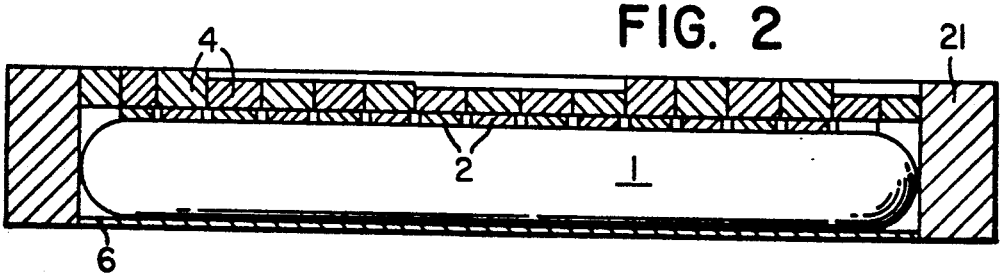
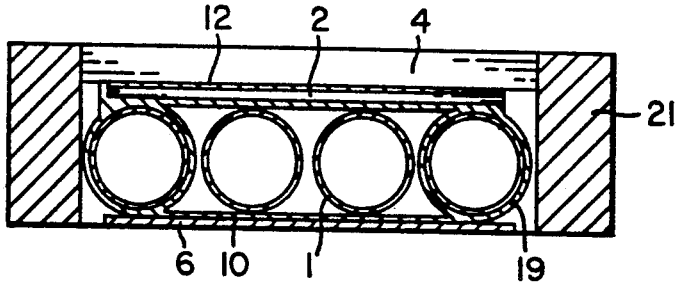
FIG. 3
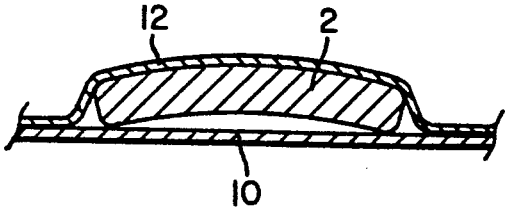
FIG. 4

FIG. 5
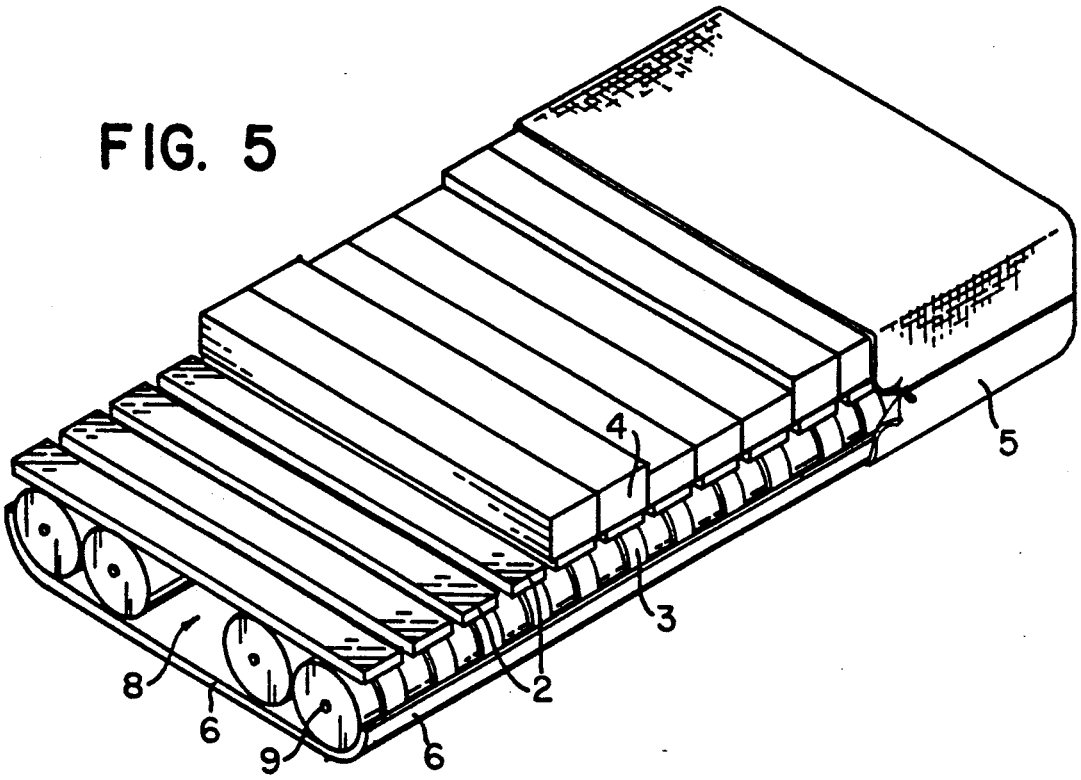
FIG. 6
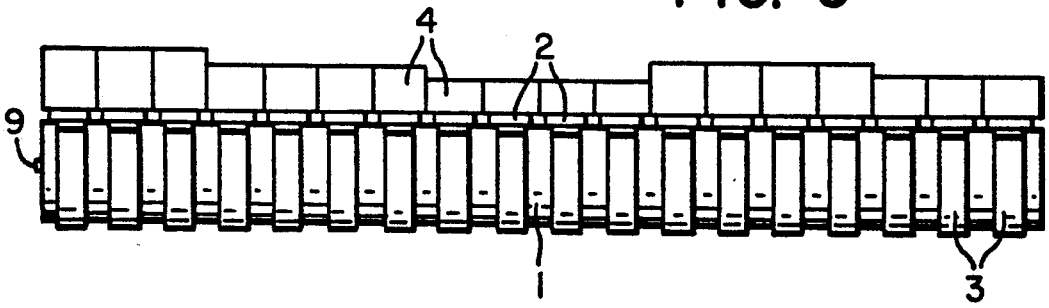
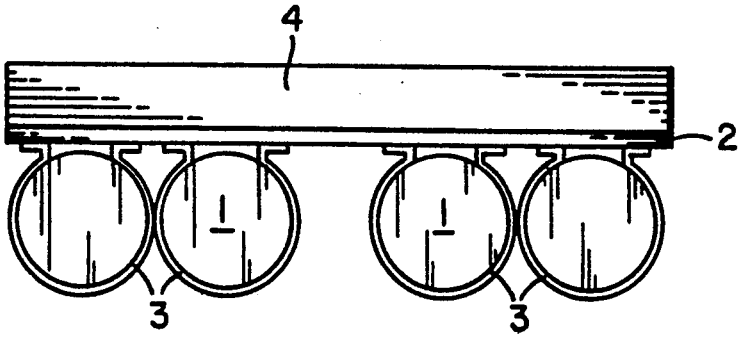
FIG. 7

PRESSURE RELIEF SUPPORT SYSTEM FOR A MATTRESS

BACKGROUND OF THE INVENTION

This invention relates to the field of mattresses and more particularly, to a pressure relief support system for a mattress capable of relieving pressure and providing maximum comfort in an environment which facilitates the healing of a patient's injuries or illnesses.

Particularly in hospitals which care to persons indefinitely confined to a bed, patients often suffer from the effects of excess pressure transmitted to their bodies. The excess pressure often results in painful bedsores and is a direct result of the mattress, the patients position therein and the length of time the patient remains in a particular position.

Hospitals rate pressure relief support systems as treatment products if they sufficiently reduce the pressure upon the patient's body, reduce tissue trauma, and facilitate the healing of skin ailments, such as burns, etc. Typical pressure relief support systems which qualify as treatment products are embodied in beds which contain motors and pumps to vary the shape and pressure within the mattress. Such beds are very expensive and require the operator to undergo extensive training to learn how to use and operate the system. Moreover, such treatment products often require extensive maintenance due to the failure of the numerous moving mechanical parts. These beds have a tendency, due to their complicated construction and design, to be extremely hot thereby transferring heat to the patient's body creating a most uncomfortable condition. Also, since these complicated pressure relief support systems require specialized bed frames they cannot be used on typical box spring mattress supports. The complicated design of these beds makes their repair very difficult often requiring complete substitution of the entire system for proper servicing.

It is therefore an object of the present invention to provide a pressure relief support system which is extremely comfortable, relatively inexpensive and utilizes a simple design so that there is no need for motors, specialized bed frames and extensive training for its use and maintenance.

It is also an object of the present invention to provide a pressure relief support system mattress which qualifies as a treatment product for use in hospitals.

It is also an object of the present invention to provide a pressure relief support system which allows for a more even body weight distribution thereby reducing pressure on the tissue and skin of the patient.

It is also an object of the invention to provide a pressure relief support system which can be customized to a particular patient's physical characteristics such as weight, contour, and body proportion.

Another object of the invention is to create a pressure relief support system which facilitates a cool, body moisture permeable bed surface for maximum patient comfort.

SUMMARY OF THE INVENTION

The present invention avoids the foregoing problems of the prior art by incorporating a pressure relief support system which meets all the aforementioned objects of the invention. The system is relatively inexpensive, simple in design, easily usable and extremely comfortable. The system according to the present invention includes the use of a plurality of air cylinders arranged in a parallel relationship to form the innards of a mattress, a plurality of slats forming a row extending across the length of the air cylinders, each slat extending substantially perpendicular across the plurality of air cylinders and being substantially parallel to, and in juxtaposition with, an adjacent slat, and means for removably securing the slats to the air cylinders.

The means for removably securing the slats may comprise a casing surrounding the air cylinders having a plurality of sleeves therein for receiving the slats. Alternatively, the means for removably securing the slats may comprise a band which fits around the perimeter of a cylinder.

The support system may also include individual foam strips each supported by the topside of a slat for improving comfort. Each of the foam strips may be of various heights, or various heights and densities, thereby allowing the foam strips to be arranged in different positions along the length of the mattress to vary the stiffness and contour of the mattress. Also, the air cylinders may be arranged to form an air space therebetween.

The pressure relief support system may contain a removable outer cover. The air cylinders may contain a valve means for easily changing the volume of air inside the cylinders which in turn alters the pressure transmitted to the patient's body. The slats may be arcuately shaped with the convex side facing opposite the air cylinders to prevent the edges of the slats from creating pressure on the patient's body.

The overall invention helps reduce pressure on a patient's body by allowing each individual wood slat to be an independent means of pressure support such that there is no shear force reacting on the patient's body throughout the length of the mattress. The system allows air cylinders and slats to be easily removed without disturbing the other slats and air cylinders. The system provides a firm yet comfortable mattress when the patient lies on the surface of the mattress nearest to the slats. Furthermore, the mattress can be turned upside down wherein the slats are on the underside to provide a softer surface which a particular patient may desire.

BRIEF DESCRIPTION OF THE DRAWINGS

FIG. 1 is an isometric drawing of the first embodiment of the improved pressure relief support system according to present invention without the outer cover and with several foam strips removed for clarity;

FIG. 2 is a sectional view of the embodiment depicted in FIG. 1 along line 2—2;

FIG. 3 is a sectional view of the embodiment depicted in FIG. 1 along line 3—3;

FIG. 4 is a cross sectional view of a slat within a sleeve useable in the system depicted in FIG. 1;

FIG. 5 is an isometric view of a second embodiment of the pressure relief support system according to the present invention with a portion of the foam strips and cover removed;

FIG. 6 is a side view of the embodiment depicted in FIG. 5 without the outer cover and liner;

FIG. 7 is a front view of the embodiment depicted in FIG. 5; and

DETAILED DESCRIPTION

Figure 8:
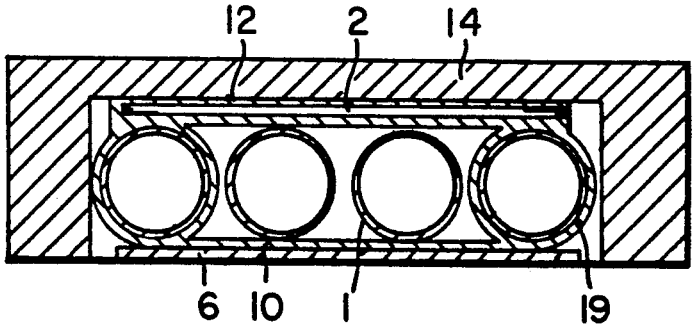
FIG. 8 is a sectional view of the embodiment of FIG. 1 the present invention including a single foam piece covering the slats in lieu of the individual foam strips.

Referring to FIGS. 1 and 5, two embodiments of the pressure relief support system in accordance with the present invention are shown. The invention will generally be described in reference to both embodiments.

As shown in FIGS. 1 and 5, the pressure relief support system preferably contains four cylindrically shaped air cylinders 1 extending longitudinally throughout the length of the entire mattress, slats 2, foam strips 4, a liner 6, an outer cover 5 and a means for removably securing the slats over the cylinders.

The positions of the air cylinders generally define the shape and size of the mattress. Each air cylinder has a valve 9 therein for allowing air to pass therethrough thereby adjusting the pressure within the cylinder. The means for removably securing the slats 2 over the cylinders 1 may include bands 3 which surround the air cylinders, as shown in FIGS. 6 and 7, or a casing 10, having sleeves 12 therein, which covers the air cylinders, as shown in FIG. 1. Using either means, the slats 2 are mounted across the air cylinders in a lateral direction substantially perpendicular to the length of the air cylinders 1 such that each slat extends continuously between each side of the mattress. The slats 2 preferably have an arcuately shaped cross section, as shown in FIG. 4, and are made of polystyrene or rigid PVC to provide a surface which is flexible yet capable of supporting heavy weight. The slats may be oriented such that the convex side of the slat is opposite the air cylinders. Since the patient will lie on the convex side of the slats, less pressure will be exerted on the patient's body from the edges of the slats. Also, each slat 2 may be spaced at an equal distance from the neighboring slat 2 throughout the entire length of the air cylinders 1 thereby forming a uniform row of slats 2.

As shown in FIGS. 1 and 5, foam strips 4 are mounted on the topside of the slats 2 such that each individual slat contains a single foam strip 4 on the top thereof. The foam strips 4 may be attached directly to the slats 2 as shown in FIG. 4, or in the embodiment of FIG. 1 directly to sleeves 12 of the casing 10, by velcro or some other suitable means. Each foam strip 4 may be of a different height. All of the foam strips may be arranged in such a manner that the overall pattern of the mattress surface may accommodate the particular contour of a patient's body. Moreover, since the foam strips 4 are removable, the strips can be rearranged to form a different contour suitable for yet a different patient.

The densities of each foam strip 4 may differ enabling the cushioning effect and pressure on each section of the patient's body to vary depending upon which particular density foam is used. Different density foam strips may be placed at different locations along the length of the mattress to accommodate a particular patient's needs. For example, at the portion of the mattress which supports the head, a softer density foam strip 4 may be used as compared to the portion of the mattress which supports the small of the back. By using various density foam strips 4, the pressure exerted on a patient's body may be varied at different locations to provide optimum comfort to the patient. By utilizing both different height and different density combinations of foam strips each individual pressure relief support system can be customized to suit a particular person's contour, and comfort needs.

The individual slats 2, and foam strips 4 thereon are capable of each holding and supporting different weights and pressures. Each slat 2 and foam strip acts as an individual support thereby reducing the shear force transmitted along the length of the pressure relief support system. This shear force is present in conventional mattresses and is transmitted directly to the patient's body. However, since the individual slats 2 and foam strips 4 do not transmit a shear force to the neighboring slat and foam strip, improved comfort is attained. Moreover, each foam strip 4 can be individually wrapped to further reduce the shear force transmitted between each individual strip. Individual wrapping of the foam strip decreases the friction between neighboring foam strips allowing each strip to more freely expand or contract relative to the adjacent foam strip. This particular feature helps to further reduce the shear force transmitted by the foam strips.

The removable outside cover 5 may be a breathable, stretchable, body moisture permeable fabric such as Gor-tex which is pleated to help reduce shear. The outside cover 5 may be capable of transmitting air from the inner portion and air space 8 shown in FIG. 5, to the patient's body. Therefore, a cool mattress surface may be created which generally is more comfortable to the patient. Moreover, the system is less propensive to heat buildup thereby further protecting the patient from dehydration. Since the outside cover 5 may be stretchable, it helps to reduce shear and pressure on the patient's body to provide for a very comfortable surface. Preferably, the removable cover 5 is also made of a material similar to Gor-tex which is body moisture permeable thereby allowing moisture from the body to pass through the removable outer cover while allowing air to flow through the cover to the patient's body. The outside cover encases the foam strips and wood slats and is shaped similar to a conventional fitted sheet for a mattress.

In the embodiment shown in FIG. 1, the slats 2 are secured by a casing 10. The casing 10 is shaped so as to allow for the air cylinders 1 to be inserted therein and form the configuration of a mattress. The casing contains a zipper 11 which allows for the air cylinders 1 to be easily accessed for insertion, removal, inflation, or deflation. The casing contains a plurality of sleeves 12 which receive the slats 2 therein. When the slats 2 are inserted into the casing sleeves 12, a row of slats extends substantially parallel across the top of the air cylinders. Also, as shown in FIG. 2, a foam border 21 may surround the perimeter of the casing 10. Although the outer cover 5 (shown in FIG. 5) is not shown in FIG. 1, the outer cover should be used thereon.

The area of the casing 10 between sleeves 12 may be perforated or air permeable to allow for air to flow through the casing to keep the mattress surface cool and comfortable. Also, as shown in FIG. 3, the casing may have supports 19 which form compartments therein where the air cylinders 10 are inserted. The compartments may be configured to prevent the air cylinders 1 from shifting out of place and/or to form air gaps between two or more cylinders 1 further helping to cool the mattress surface. Between the outer cover 5 and the bottom of the air cylinders 1 is a felt liner 6 which helps prevent friction between the cylinders 1 and the outer cover 5. The outer cover 5 may completely surround the casing and contain a zipper located on the side and ends to allow access to the casing 10, slats 2, and cylinders 1.

In the embodiment depicted in FIG. 5, each slat 2 preferably contains individual bands 3 capable of receiving an air cylinder 1 which may be insertable therethrough. For example, as shown in FIG. 7, four different bands 3 may be located on each of the slats 2 as shown in FIG. 7. Alternatively, two bands, each capable of surrounding two cylinders 1, may be spaced on each end of each slat. The position of the slats may enable an air space 8 to be created in the center of the mattress unit when the air cylinders 1 are inserted through each of the loops formed by the bands. Each slat 2 must be positioned on each of the air cylinders 1 by inserting the air cylinders 1 into the similarly positioned bands 3 on each slat. The bands may be located at particular areas of the slats 2 to provide for an airspace between air cylinders as shown in FIG. 4. Since this embodiment does not include a casing (but utilizes individual foam strips directly on top of individual slats), air from within the air space 8 is allowed to flow between each individual foam strip to the surface of a mattress. Air flows within the air passage of the mattress and between the sections of the foam strips to the removable outside cover 5 of the mattress.

The number and position of the bands 3 on each slat may vary depending upon the desired air cylinder configuration. Also, means other than a band 3 may also be used to secure the air cylinder to the slat. However, such a means should preferably function to allow the air cylinder to be easily replaced in case of a failure. Therefore, the air cylinders may be easily changed without dismantling the entire support system.

In both the embodiment of FIG. 1 and FIG. 5, the foam strips may be eliminated from the system such that the outer cover 5 surrounds the air cylinders 1 and slats 2 without foam strips. The patient may lie on the surface of the system directly on top of the slats 2. Alternatively, a solid piece of foam 14 may be placed on top of the slats in lieu of the individual foam strips as shown in FIG. 8. The foam 14 covers the sides and the top of the casing 10. Despite the absence of the foam strips, the pressure on the patient's body is substantially reduced over conventional mattresses. The individual slats 2 provide a substantially shear free surface upon the body to create a firm, comfortable surface. The pressure relief support system may also be used in a inverted or upside down position so that the patient lies upon the air cylinder 10 side of the mattress and the slats 2 are located below the air cylinders 1. In this manner, the slats 2 are not in contact with the patient's body. When the pressure relief support system is used in this way, a hammocking effect is created on the patient's body and the patient feels a much softer surface. This may be appropriate when, for instance, the patient suffers severe burns along the back of his body.

While the invention has been described and illustrated in the embodiments depicted herein, it is not intended to be limited to the details shown, since various modifications and structural changes may be made without departing, in any way, from the spirit of the invention. Any such modifications are intended to be within the scope of the invention as defined by the claims.

I claim:

1. A pressure relief support system for a mattress comprising:

a plurality of elongate air cylinders arranged in a parallel relationship to form the innards of a mattress;

a plurality of slats forming a row of slats extending across the length of the air cylinders, each salt extending substantially perpendicular across the plurality of air cylinders and being substantially parallel to, and in juxtaposition with, an adjacent slat;

a plurality of individual foam strips, each foam strip supported by the topside of one of said slats, said foam strips extending substantially the length of the slat; and means for securing each of the slats over the air cylinders wherein any of the air cylinders can be removed without disturbing the slats or remaining cylinders.

2. The pressure relief support system of claim 1 wherein the means for removably securing the slats comprises a band affixed to each slat which fits around one or more air cylinders.

3. The pressure relief support system of claim 2 wherein the means for removably securing the slats over the air cylinders comprises a casing surrounding the air cylinders having a plurality of sleeves therein for receiving the slats.

4. The pressure relief support system of claim 1 further comprising a removable outer cover.

5. The pressure relief support system of claim 1 wherein the foam strips comprise removable foam strips of various heights.

6. The pressure relief support system of claim 1 wherein the foam strips comprise removable foam strips of various heights and densities thereby allowing the foam strips to be arranged in different positions along the length of the mattress to allow the stiffness and contour of the surface of the mattress to vary.

7. The pressure relief support system of claim 1 wherein the slats are arcuately shaped in cross section, the slats having the convex side facing opposite the air cylinders.

8. The pressure relief support system of claim 1 further comprising a valve means on the air cylinders for allowing the air pressure within the cylinders to vary.

9. The pressure relief support system of claim 1 wherein two or more air cylinders are arranged to form an airspace therebetween.

10. A pressure relief support system for a mattress comprising:

a plurality of elongate air cylinders arranged in parallel relationship;

a casing surrounding the air cylinders having a plurality of sleeves therein each sleeve extending perpendicularly across the cylinders within the casing and being substantially parallel to, and in juxtaposition with, and adjacent sleeve;

a plurality of slats having an arcuate cross section, said slats insertable within the sleeves thereby being arranged in a substantially parallel relationship with each other and extending substantially perpendicular across the top of the air cylinders thereby forming a row of slats extending across the length of the air cylinders;

a plurality of individual foam strips, each foam strip supported by the topsides of one of the slats;

a protective liner contacting the bottom portion of the air cylinders; and a removable outer cover for encasing the foam strips and slats.

11. A pressure relief support system for a mattress comprising:

a plurality of elongate air cylinders arranged in parallel relationship to form the innards of a mattress;

a plurality of slats having an arcuate cross-section, each slat having one or more bands affixed thereto to form one of more loops;

the cylinders being insertable within the corresponding loops formed by the hands on each slat thereby forming a row of slats extending substantially perpendicular across the plurality of air cylinders and being substantially parallel to, and in juxtaposition with, an adjacent slat;

a plurality of foam strips, each strip removably secured to the top of the slats, and said individual foam strips extending substantially the length of a slat;

a protective liner contacting the bottom portion of the air cylinders;

a removable outer cover for encasing the foam strips and slats.

12. The pressure relief support system of claim 10 or 11 wherein the foam strips may be of various heights densities thereby allowing the foam strips to be arranged in different positions along the length of the mattress to allow the stiffness and contour of the mattress surface to vary.

* * * * *

UNITED STATES PATENT AND TRADEMARK OFFICE

CERTIFICATE OF CORRECTION

PATENT NO. : 5,070,560

DATED : December 10, 1991

INVENTOR(S) : WILKINSON

It is certified that error appears in the above-identified patent and that said Letters Patent is hereby corrected as shown below:

Title page, item [56]:

In the "References Cited"

Under "U.S. PATENT DOCUMENTS" add:

| | | | |
|---|---|---|---|
| --2,225,858 | 12/1940 | Church . . . . | 5/239 |
| 2,638,606 | 5/1953 | Austin . . . . | 5/239 |
| 3,967,331 | 7/1976 | Glassman . . . | 5/236R |
| 4,181,991 | 1/1980 | Morgan et al.. | 5/400 |
| 4,477,935 | 10/1984 | Griffin . . . | 5/241-- |

Under "FOREIGN PATENT DOCUMENTS" add:

| | | | |
|---|---|---|---|
| -- 336864 | 4/1965 | Switzerland . | 34g/17.03 |
| 2254986 | 11/1972 | German . . . . | 34g/23.06 |
| 2407692 | 11/1977 | French . . . . | --/-- -- |

Column 3, line 41, change "Figure 4" to --Figure 5--.

Column 5, line 14, change "4" to --7--.

Column 5, line 43, change "a" to --an--.

Column 5, line 45, change "10" to --1--.

UNITED STATES PATENT AND TRADEMARK OFFICE

CERTIFICATE OF CORRECTION

PATENT NO. : 5,070,560

DATED : December 10, 1991

INVENTOR(S) : Wilkinson

It is certified that error appears in the above-indentified patent and that said Letters Patent is hereby corrected as shown below:

Column 5, claim 1, line 68, change "salt" to --slat--.
Column 6, claim 3, line 17, change "2" to --1--.
Column 6, claim 10, line 48, after "therein" insert --,--; and line 51, change "and" to --an--.
Column 7, claim 11, line 4, change "of" to --or--; and line 6, change "hands" to --bands--.
Column 8, claim 12, line 8, after heights" insert --and--.

Signed and Sealed this

Twenty-second Day of February, 1994

*Attest:*

*Attesting Officer*

BRUCE LEHMAN

*Commissioner of Patents and Trademarks*